US011202154B2

(12) United States Patent
Pan et al.

(10) Patent No.: US 11,202,154 B2
(45) Date of Patent: Dec. 14, 2021

(54) SPEAKER INCLUDES A SECOND FIXING ARM OF AN ELASTIC SUPPORTING MEMBER SANDWICHED BETWEEN TWO INDEPENDENTLY CONTROLLED VOICE COILS

(71) Applicant: AAC Technologies Pte. Ltd., Singapore (SG)

(72) Inventors: Kaitai Pan, Los Angeles, CA (US); Xingzhi Huang, Shenzhen (CN); Chao Wang, Shenzhen (CN); Bin Xu, Shenzhen (CN); Henglizi Zhang, Shenzhen (CN); Lijian Ye, Shenzhen (CN); Yao Hui, Shenzhen (CN); Feng Shan, Shenzhen (CN); Zijie Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/935,181

(22) Filed: Jul. 21, 2020

(65) Prior Publication Data

US 2021/0029464 A1 Jan. 28, 2021

(30) Foreign Application Priority Data

Jul. 22, 2019 (CN) ..... 201910662748.0

(51) Int. Cl.
*H04R 9/04* (2006.01)
*H04R 9/02* (2006.01)

(52) U.S. Cl.
CPC ..... *H04R 9/04* (2013.01); *H04R 9/025* (2013.01); *H04R 2209/024* (2013.01); *H04R 2209/041* (2013.01)

(58) Field of Classification Search
CPC ..... H04R 19/00; H04R 19/01; H04R 19/016; H04R 19/02; H04R 2400/03; H04R 13/02;
(Continued)

(56) References Cited

U.S. PATENT DOCUMENTS 9,813,821 B1 * 11/2017 Song ..... H04R 9/025
2018/0367917 A1 * 12/2018 Choisel ..... H03G 3/3005

FOREIGN PATENT DOCUMENTS

CN 203313392 U * 11/2013 ..... H04R 90/02

* cited by examiner

*Primary Examiner* — Ahmad F. Matar
*Assistant Examiner* — Sabrina Diaz
(74) *Attorney, Agent, or Firm* — W&G Law Group

(57) ABSTRACT

The present invention provides a speaker having a vibrating system and a magnetic circuit system for driving the vibrating system to vibrate and sound. The magnetic circuit system has magnetic gap. The vibrating system includes vibrating assembly and voice coil assembly connected to the vibrating assembly, the voice coil assembly is inserted into the magnetic gap. The magnetic circuit system has a magnetic line concentrating area in the magnetic gap. The voice coil assembly includes a first voice coil connected to the vibrating assembly and a second voice coil arranged on the first voice coil at a side away from the vibrating assembly. if in the magnetic line concentrating area locates only the first voice coil, an electric signal is input only to the first voice coil; if in the magnetic line concentrating area locates only the second voice coil, electric signal is input only to the second voice coil.

11 Claims, 7 Drawing Sheets

(58) Field of Classification Search
CPC ..... H04R 9/06; H04R 9/025; H04R 9/063; H04R 9/02; H04R 9/045; H04R 9/046; H04R 9/041; H04R 9/043; H04R 9/04; H04R 7/16; H04R 1/06; H04R 2209/022; H04R 2209/024; H04R 2209/041; B06B 1/0292; H04M 1/03
USPC ..... 381/191, 396, 400, 401, 405, 409, 412, 381/420–422
See application file for complete search history.

SPEAKER INCLUDES A SECOND FIXING ARM OF AN ELASTIC SUPPORTING MEMBER SANDWICHED BETWEEN TWO INDEPENDENTLY CONTROLLED VOICE COILS

FIELD OF THE PRESENT INVENTION

The present invention relates to the technical field of acoustic design, and more particularly to a speaker.

DESCRIPTION OF RELATED ART

With the advent of the mobile Internet era, the number of smart mobile devices is continuously increasing. Among these numerous mobile devices, mobile phones are undoubtedly the most common and portable mobile terminal devices. Speakers for playing sound are widely used in current smart mobile devices such as cellphones.

The existing speaker includes a frame, a vibrating system and a magnetic circuit system with a magnetic gap both fixed on the frame. The magnetic circuit system includes a yoke fixed on the frame, a main magnet fixed on the yoke, auxiliary magnets forming a magnetic gap together with the main magnet, and a single voice coil inserted into the magnetic gap for driving the vibrating system to vibrate and produce sound. When driving the vibrating system to vibrate for producing sound, the current single voice coil is in a relative high effective heat power. In order to reduce the effective heat power of the single voice coil, a dual voice coil structure is designed and the two voice coils are connected in series. Experiments show that the effective heat power in the dual voice coil speaker in series decreases 5.9572% compared to that in the single voice coil speaker. Although the effective heat power has decreased by 5.9572%, the decrease amplitude is too small to meet the needs of power consumption reduction.

Therefore, it is desired to provide a new speaker which can overcome the above-mentioned problems.

SUMMARY OF THE PRESENT INVENTION

The purpose of the present invention is to provide a speaker, which can greatly reduce the effective heat power.

The purpose of the present invention is achieved by the following technical solution.

In one aspect, a speaker, comprising a vibrating system and a magnetic circuit system for driving the vibrating system to vibrate and generate sound, wherein, the magnetic circuit system has a magnetic gap, the vibrating system comprises a vibrating assembly and a voice coil assembly connected to the vibrating assembly for driving the vibrating assembly to vibrate, the voice coil assembly is inserted into the magnetic gap; the magnetic circuit system has a magnetic line concentrating area in the magnetic gap, the voice coil assembly comprising a first voice coil connected to the vibrating assembly and a second voice coil connected to the first voice coil at a side away from the vibrating assembly; if the first voice coil located in the magnetic line concentrating area, an electric signal is input only to the first voice coil; if the second voice coil located in the magnetic line concentrating area, an electric signal is input only to the second voice coil.

In the embodiment, wherein the magnetic circuit system includes a magnetic bowl and a magnet assembly fixed in the magnetic bowl and forming the magnetic gap with the magnetic bowl; the magnet assembly comprises a magnet and a pole plate stacked on the magnet, the pole plate includes a first surface connected to the magnet and a second surface arranged opposite to the first surface, an area of the magnetic gap located between a plane where the first surface is located and another plane where the second surface is the magnetic line concentrating area.

In the embodiment, wherein the magnetic circuit system comprises a main magnet assembly and an auxiliary magnet assembly spaced apart from the main magnet assembly and forming the magnetic gap; the main magnet assembly includes a first main magnet and a main pole plate stacked on the first magnet, the auxiliary magnet assembly includes two first auxiliary magnets symmetrically arranged on two opposite sides of the first main magnet and an auxiliary pole plate stacked on the first auxiliary magnets; a plane connecting an upper surface of the main pole plate with an upper surface of the auxiliary pole plate is defined as a first plane, another plane connecting a lower surface of the main pole plate with a lower surface of the auxiliary pole plate is defined as a second plane, an area of the magnetic gap located between the first plane and the second plane is the magnetic line concentrating area.

In the embodiment, wherein the main magnet assembly further comprises a second main magnet arranged on the main pole plate at a side away from the first main magnet, the auxiliary magnet assembly further comprises a second auxiliary magnet arranged on the auxiliary pole plate at a side away from the first auxiliary magnet; the corresponding ends of the first main magnet and the second main magnet have the same polarity, the corresponding ends of the first auxiliary magnet and the second auxiliary magnet have the same polarity, and the polarity of the corresponding ends of the first main magnet and the second main magnet is opposite to the polarity of the corresponding ends of the first auxiliary magnet and the second auxiliary magnet.

In the embodiment, wherein the speaker further comprises an elastic supporting member and a frame for receiving the vibrating system and the magnetic circuit system; one side of the elastic supporting member is connected to the auxiliary pole plate or the frame, the other side of the elastic supporting member is connected to the voice coil assembly.

In the embodiment, wherein the speaker has two elastic supporting members, the voice coil assembly has a rectangular structure with rounded corners, the two auxiliary magnets are arranged on two sides of the voice coil assembly corresponding to a long axis of the voice coil assembly, and the two elastic supporting members are arranged on two sides of the voice coil assembly corresponding to a short axis of the voice coil assembly.

In the embodiment, wherein the auxiliary pole plate has an annular shape, the auxiliary pole plate comprises two first pole plate portions each opposite to the corresponding auxiliary magnet and two second pole plate portions sandwiched between the two first pole plate portions; one side of each elastic supporting member is connected to one of the second pole plate portions, and the other side of each elastic supporting member is connected to the voice coil assembly.

In the embodiment, wherein each elastic supporting member comprises a first fixing arm connected to the second pole plate portions, a second fixing arm connected to the voice coil assembly, and an elastic arm connected between the first fixing arm and the second fixing arm.

In the embodiment, wherein the second fixing arm is sandwiched between the first voice coil and the second voice coil.

In the embodiment, wherein the elastic supporting member is a flexible circuit board, the first voice coil and the second voice coil are electrically connected to the elastic supporting member.

In the embodiment, wherein the vibrating assembly comprises an annular vibrating diaphragm and a dome arranged on the inner side of the annular vibrating diaphragm, and the first voice coil is connected to the annular vibrating diaphragm.

In the embodiment, wherein a height of the first voice coil is equal to a height of the second voice coil.

In the embodiment, wherein a thickness of the first voice coil is equal to a thickness of the second voice coil.

Compared to the prior art, the embodiment of the present invention provides a voice coil assembly with a first voice coil and a second voice coil. If in the magnetic line concentrating area locates only the first voice coil, an electric signal is input only to the first voice coil; while if in the magnetic line concentrating area locates only the second voice coil, an electric signal is input only to the second voice coil. By this way, electric current is only input to the voice coil located in the magnetic concentrating area, so the voice coil assembly can greatly reduce the effective heat power of the voice coil assembly while driving the vibrating system to vibrate and sound.

DETAILED DESCRIPTION OF THE EXEMPLARY EMBODIMENT

The present invention will be further described in detail with reference to the drawings and embodiments.

It should be noted that all directional indicators (such as upper, lower, left, right, front, back, inner, outer, top, bottom, etc.) in the embodiments of the present invention are barely used for explaining the relative positional relationships and the like among the various components in a specific posture (shown in the figures). If the specific posture changes, the directional indicator will also changes accordingly.

It should also be noted that when an element is referred as "fixed on" or "arranged on" another element, the element may be directly fixed on the other element or a centering element may exist at the same time. When an element is referred as "connected to" another element, it can be directly connected to another element or a centering element may exist at the same time.

Figure 1:
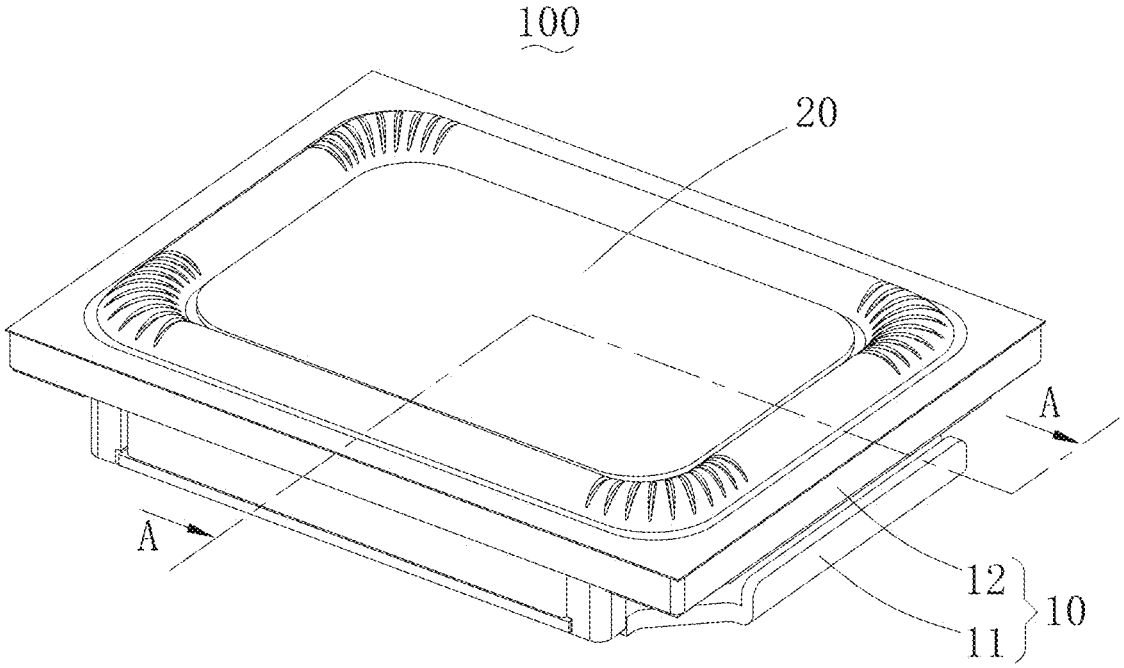
FIG. 1 is a schematic view of a speaker according to an embodiment of the present invention.
Figure 2:
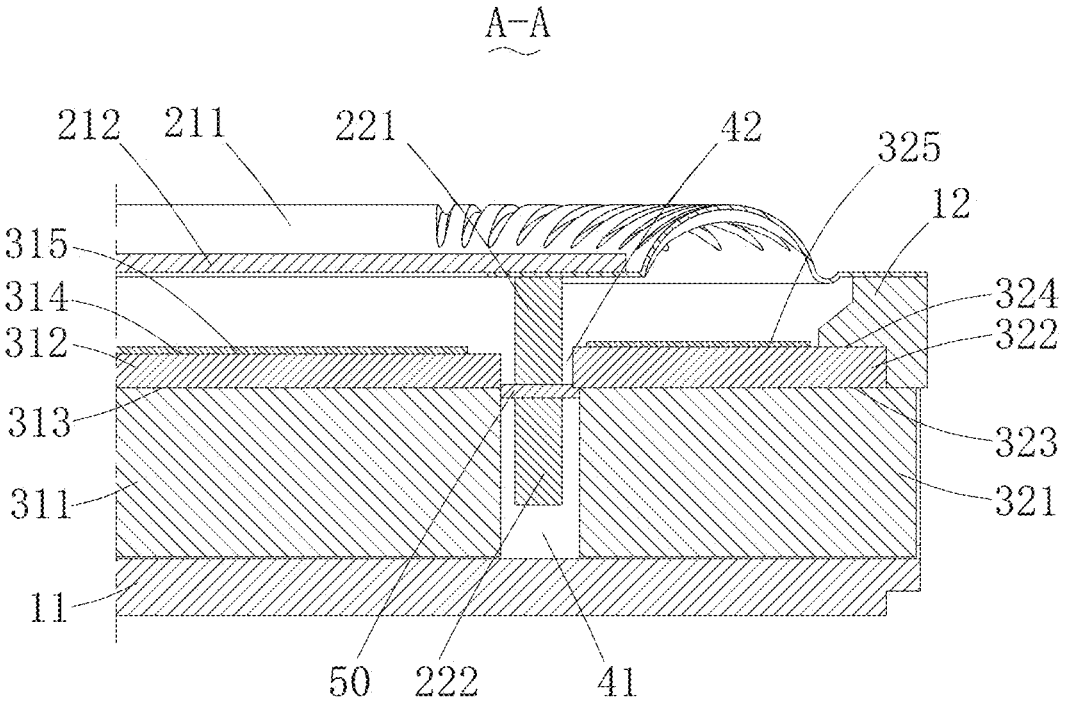
FIG. 2 is a cross-sectional view taken along line A-A in FIG. 1.
Figure 3:
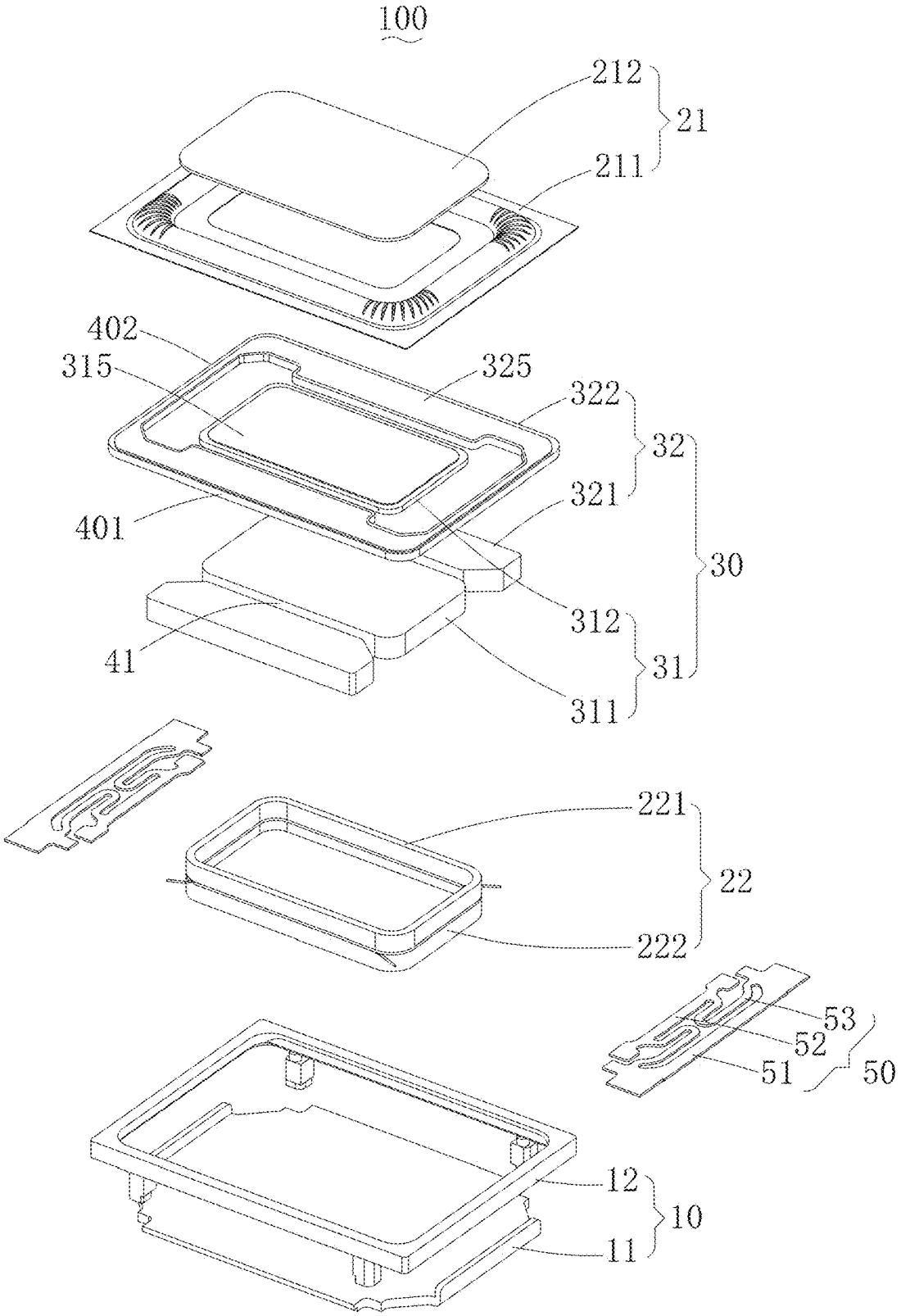
FIG. 3 is an exploded view of the speaker according to the embodiment of the present invention.

Referring to FIG. 1 to FIG. 3, an embodiment of the present invention discloses a speaker 100, which includes a frame 10, a vibrating system 20 and a magnetic circuit system 30. The vibrating system 20 and the magnetic circuit system 30 are arranged on the frame 10, and the magnetic circuit system 30 is used for driving the vibrating system 20 to vibrate and sound.

The frame 10 includes a yoke 11 and a supporting frame 12, the vibrating system 20 is connected to the supporting frame 12, and the magnetic circuit system 30 is arranged in the intermediate position of the yoke 11.

The vibrating system 20 includes a vibrating assembly 21 and a voice coil assembly 22 connected to the vibrating assembly 21 for driving the vibrating assembly 21 to vibrate and sound. The vibrating assembly 21 includes an annular vibrating diaphragm 211 and a dome 212. An outer side of the annular vibrating diaphragm 211 is connected to the supporting frame 12, and an inner side of the annular vibrating diaphragm 211 is connected to the dome 212.

The magnetic circuit system 30 has magnetic gap 41, and the voice coil assembly 22 is inserted into the magnetic gap 41. The magnetic circuit system 30 has a magnetic line concentrating area 42 in the magnetic gap 41. The voice coil assembly 22 includes a first voice coil 221 connected to the vibrating system 20 and a second voice coil 222 connected to the first voice coil 221 at a side away from the vibrating system 20. If in the magnetic line concentrating area 42 locates only the first voice coil 221, an electric signal is input only to the first voice coil 221, while if in the magnetic line concentrating area 42 locates only the voice coil 222, an electric signal is input only to the second voice coil 222.

In the present embodiment, when only the first voice coil 221 is located in the magnetic line concentrating area 42, the electric signal is input only to the first voice coil 221, while when only the second voice coil 222 is located in the magnetic line concentrating area 42, the signal is input only to the voice coil 222. With this configuration, the voice coil assembly 22 can greatly reduce the effective heat power of the voice coil assembly 22 while driving the vibrating system 20 to vibrate and sound.

Figure 4:
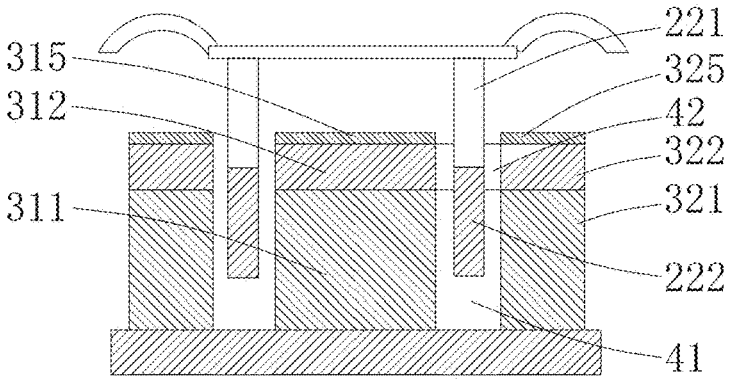
FIG. 4 is a schematic view of the speaker according to the embodiment of the present invention in a first operating state.
Figure 5:
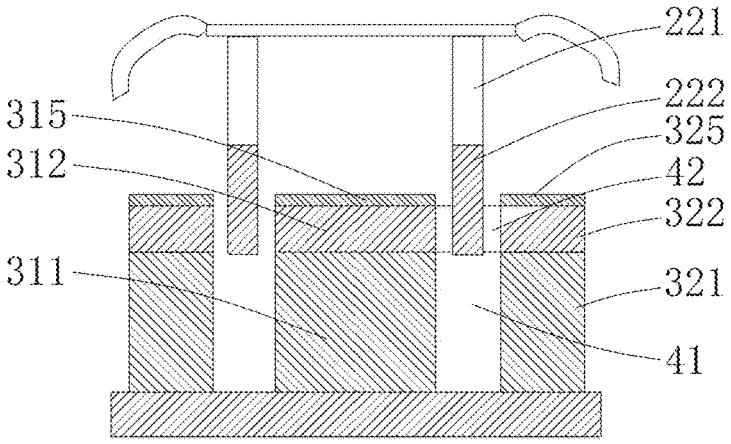
FIG. 5 is a schematic view of the speaker according to the embodiment of the present invention in a second operating state.
Figure 6:
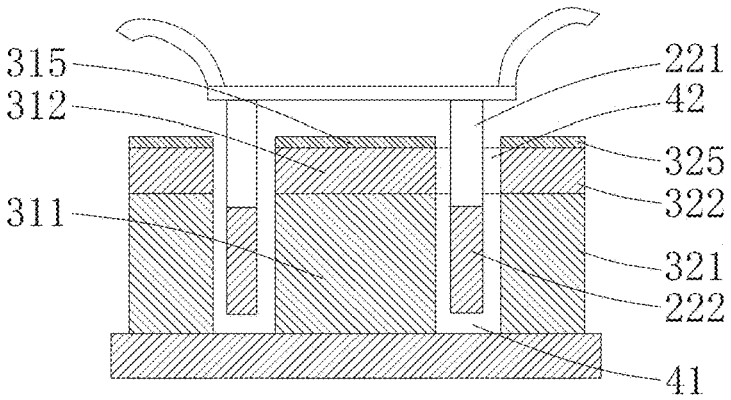
FIG. 6 is a schematic view of the speaker according to the embodiment of the present invention in a third operating state.

In the following, with the three motion states of the voice coil assembly 22, the reason why the above controlling method of electric signal input can greatly reduce the effective heat power will be explained. As shown in FIG. 4, in an initial position, a joint of the first voice coil 221 and the second voice coil 222 is located in the middle of the magnetic line concentrating area 42, and both the first voice coil 221 and the second voice coil 222 are partially located in the range of the magnetic line concentrating area 42. In this case, the current inputted to the first voice coil 221 and the second voice coil 222 can both effectively control the first voice coil 221 and the second voice coil 222 to cut the magnetic lines, and the power consumption of the first voice coil 221 and the second voice coil 222 is equivalent to the power consumption of the prior single voice coil. As shown in FIG. 5, when the voice coil assembly 22 is significantly shifted along the direction toward the vibrating assembly 21 until only the second voice coil 222 is remained in the magnetic line concentrating area 42, since the first voice coil 221 has largely deviated from the magnetic line concentrating area 42, even if an electric current is input to the first voice coil 221, the magnetic lines in the magnetic line concentrating area 42 have still no effect on the first voice coil 221. Therefore, the first voice coil 221 can be input with no electric current, the heat power of the first voice coil 221 thus can be reduced. As shown in FIG. 6, when the voice coil assembly 22 is significantly shifted along the direction away from the vibrating assembly 21 until only the first voice coil 221 is remained in the magnetic line concentrating area 42, since the second voice coil 222 has largely deviated from the magnetic line concentrating area 42, even if an electric current is input to the second voice coil 222, the magnetic lines in the magnetic line concentrating area 42 have still no effect on the second voice coil 222. Therefore the second voice coil 222 can be input with no electric current, the heat power of the second voice coil 222 thus can be reduced.

Figure 7:
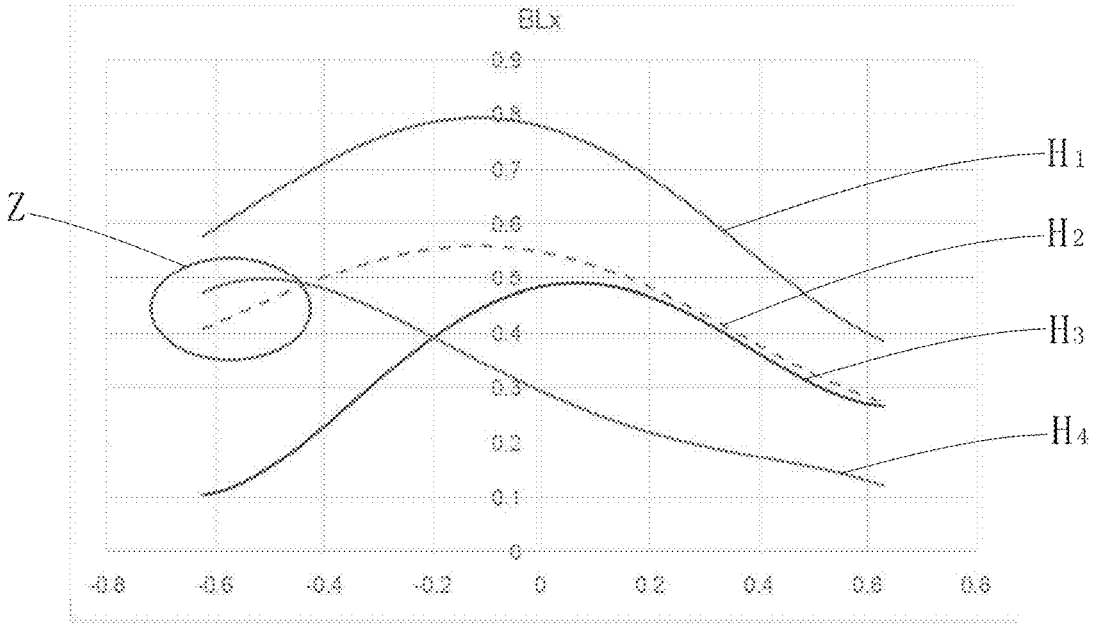
FIG. 7 is a schematic view of BL curves of a voice coil assembly, a first voice coil, and a second voice coil.

Please refer to FIG. 2 and FIG. 7, the following is the explanation how to determine whether the heat power of the voice coil assembly 21 is reduced according to the BL curves.

In FIG. 7, curve $H_1$ represents the BL curve $BL_{total}$ of the voice coil assembly 22, curve $H_2$ represents the BL curve $BL_{total}/\sqrt{2}$ of the voice coil assembly 22, curve $H_3$ represents the BL curve $BL_{down}$ of the second voice coil 222, and curve $H_4$ represents the BL curve $BL_{up}$ of the first voice coil 221.

As the driving force of the voice coil cannot be reduced, formula (1) is obtained:

$$BL_{total} \times I = BL_{up} (\text{or } BL_{down}) \times I^* \quad (1),$$

wherein, I is a current flowing in the voice coil assembly 22, and I' is a current input to the first voice coil 221 or the second voice coil 222 when the first voice coil 221 or the second voice coil 222 is located in the magnetic line concentrating area.

As the power consumption is reduced, formula (2) is obtained:

$$I^2 \times R \geq I^{*2} \times R/2 \quad (2)$$

wherein, R is a resistance value of the voice coil assembly 22.

Formula (3) is obtained by putting the formula (1) into the formula (2):

$$BL_{total}/\sqrt{2} \leq BL_{up} (\text{or } BL_{down}) \quad (3);$$

and a loading voltage of a corresponding single voice coil is:

$$U = \frac{BL_{total}(X_0) * U_{origin}}{2 * \text{MAX}(BL_{down}(X_c),\ BL_{up}(X_0))}. \quad (4)$$

The formula (4) can be used as a basis for judging that the single voice coil can reduce power consumption. As shown in FIG. 7, only the part circled by Z in the elliptical area in FIG. 7 satisfies the condition of formula (4). That is, for the solution that a single coil is input with an electric current, only in this section will the power consumption be reduced.

The intersection of the curve $BL_{total}/\sqrt{2}$ and the curve $BL_{up}$ is a transition region where the voltage is loaded from the dual voice coil to the single voice coil. $U_{origin}$U is a sum of the voltages loaded to the two voice coils before the intersection.

Figure 8:
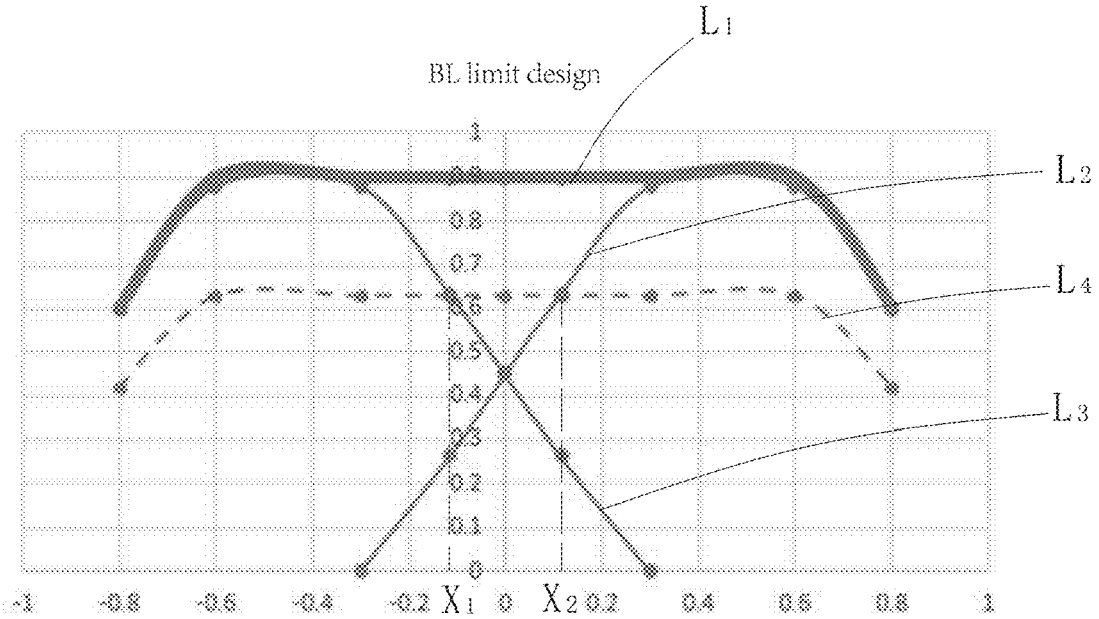
FIG. 8 a schematic view of BL curves of the speaker according to the embodiment of the present invention.
Figure 9:
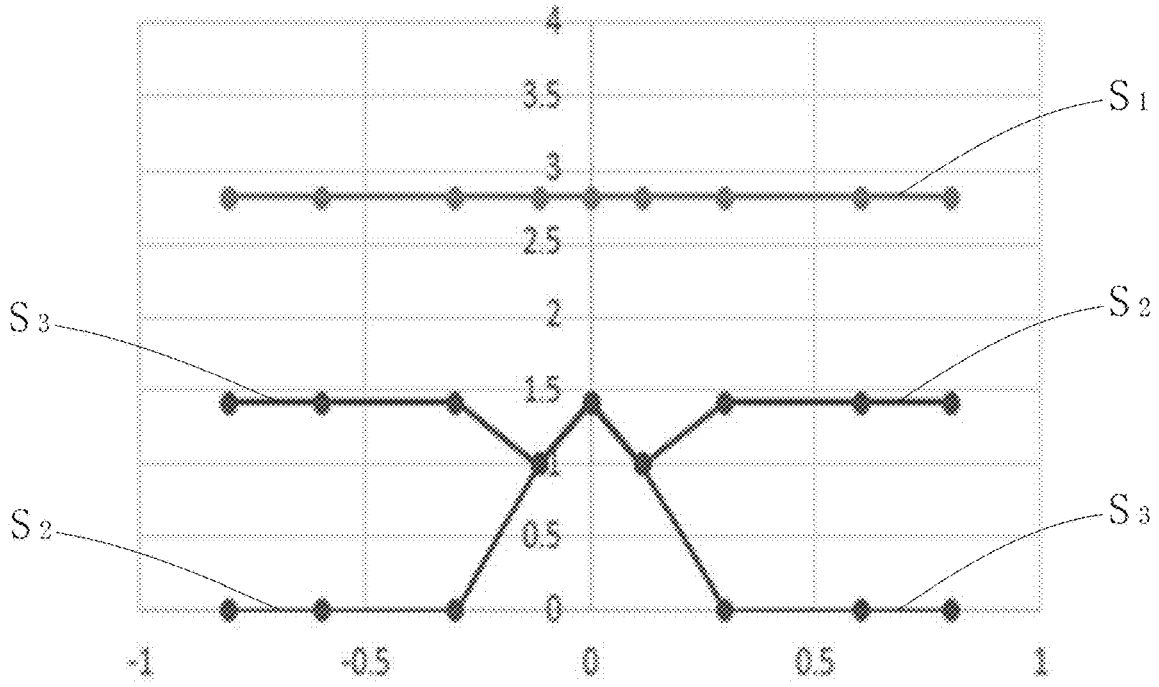
FIG. 9 is a schematic view of voltage curves of the voice coil assembly, the first voice coil and the second voice coil.

According to FIG. 8 and FIG. 9, in FIG. 8, curve $L_1$ is a BL curve of the voice coil assembly 21, curve $L_2$ is a BL curve of the second voice coil 222, curve $L_3$ is a BL curve of the first voice coil 221, and curve $L_4$ is an energy saving benchmark curve. In FIG. 9, $S_1$ is a voltage curve of the voice coil assembly 21, $S_2$ is a voltage curve of the second voice coil 222, and $S_3$ is a voltage curve of the first voice coil 221. When $X_1$=−0.115 and $X_2$=0.115, the effective heat power of the voice coil assembly 22 is reduced by 44.5% relative to the single voice coil. The specific calculating process is as follows.

The $BL_X$ curve is realized by the magnetic field focusing design. An intersection of the dotted line and the solid line X1 is used as a boundary, and formula 4 is the loading voltage in the area where the solid line is higher than the dotted line. The corresponding power saving amount is:

$$\varepsilon = \frac{2 * U^2}{U_{origin}^2} = \int_{x1}^{amplitude\ A} 2 * \left( \frac{BL_{total}(X_1)}{2\text{MAX}(BL_{down}(X_1) BL_{up}(X_1))} \right)^2 dx.$$

The loading signal is set as simple harmonic wave. A moving speed of the voice coil is larger in the interval $X_1$ to $X_2$, and the corresponding time proportion is smaller. The f final total power saving efficiency is calculated and obtained as follows:

$$\alpha = \frac{\left[ \left( \arcsin\left(\frac{1}{A}\right) - \arcsin\left(\frac{0.115}{A}\right) \right) \right] * \varepsilon}{\arcsin(0.115/A)}.$$

The first voice coil 221 is connected to the annular vibrating diaphragm 211.

As an improvement of the embodiment, the magnetic circuit system 30 includes a main magnet assembly 31 and an auxiliary magnet assembly 32, which is spaced from the main magnet assembly 31 and thus forming the magnetic gap 41. The main magnet assembly 31 includes a first main magnet 311 and a main pole plate 312 stacked on the first main magnet 311. The auxiliary magnet assembly 32 includes two first auxiliary magnets 321 arranged on two opposite sides of the first main magnet 311 symmetrically and an auxiliary pole plate 322 stacked on the first auxiliary magnets 321. A plane connecting an upper surface 313 of the main pole plate 312 with an upper surface 323 of the auxiliary pole plates 322 is defined as a first plane. Another plane connecting a lower surface 314 of the main pole plate 312 with a lower surface 324 of the auxiliary pole plate 322 is defined as a second plane. An area of the magnetic gap 41 between the first plane and the second plane is the magnetic line concentrating area 42.

As an improvement of the embodiment, the main magnet assembly 31 further comprises a second main magnet 315 arranged on the main pole plate 312 at a side away from the first main magnet 311. The auxiliary magnet assembly 32 further includes a second auxiliary magnet 325 arranged on the auxiliary pole plate 322 at a side away from the first auxiliary magnet 321. The corresponding ends of the first main magnet 311 and the second main magnet 315 have the same polarity, and the corresponding ends of the first auxiliary magnet 321 and the second auxiliary magnet 325 have the same polarity. The polarity of the corresponding ends of the first main magnet 311 and the second main magnet 315 is opposite to the polarity of the corresponding ends of the first auxiliary magnet 321 and the second auxiliary magnet 325. For example, the corresponding ends of the first auxiliary magnet 321 and the second auxiliary magnet 325 are both N pole, and the other corresponding ends of the first auxiliary magnet 321 and the second auxiliary magnetic 325 are both S pole. With the configuration of the second main magnet 315 and the second auxiliary magnet 325, the magnetic field lines between the main magnet assembly 31 and the auxiliary magnet assembly 32 can be focused in the magnetic line concentrating area 42, so the driving force for the voice coil assembly 22 can be improved. That is, in the case of obtaining the same driving force, a smaller electric signal can be input to the voice coil assembly 22, thereby achieving a better energy saving effect.

Figure 10:
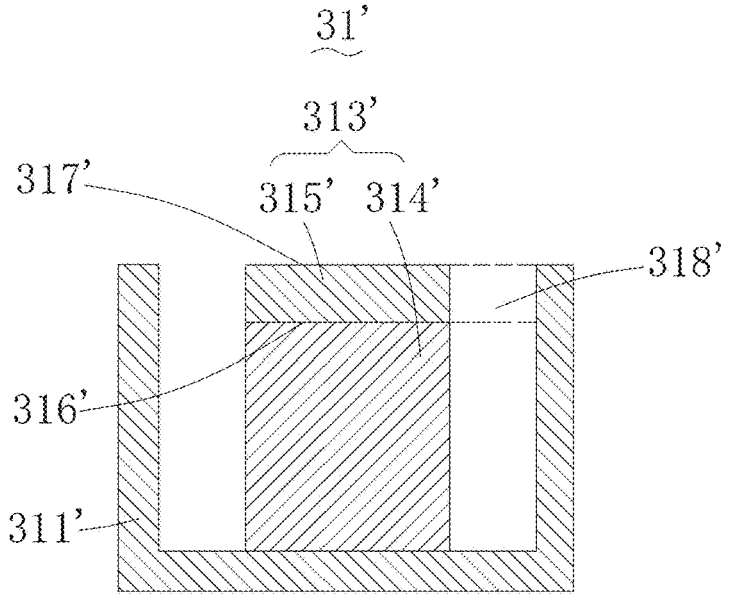
FIG. 10 is a schematic view of a magnetic circuit assembly according to another embodiment of the present invention.

Please refer to FIG. 10, it should be noted that the magnetic circuit system is not limited to the above configuration. For example, the magnetic circuit system 31' may also be configured to include a magnetic bowl 311' and a magnet assembly 313' fixed in the magnetic bowl 311' and forming magnetic gap 312' with the magnetic bowl 311'. The magnet assembly 313' includes a magnet 314' and a pole plate 315' covered on the magnet 314'. The pole plate 315' includes a first surface 316' connected to the magnet 314' and a second surface 317' arranged opposite to the first surface 316'. An area of the magnetic gap 41 between a plane where the first surface 316' is located and another plane where the second surface 317' is located is the magnetic concentrating area 42.

As an improvement of the embodiment, a height of the first voice coil 221 is equal to a height of the second voice coil 222, wherein the height of the first voice coil 221 refers to a distance between the two surfaces of the first voice coil 221 in the vibrating direction of the first voice coil 221, and the height of the second voice coil 222 refers to a distance between two surfaces of the second voice coil 222 in the vibrating direction of the second voice coil 222. Of course, the height of the first voice coil 221 may also be unequal to that of the second voice coil 222. In this case, the BL curve of the first voice coil 221 and the BL curve of the second voice coil 222 are asymmetric, a height ratio between the first voice coil 221 and the second voice coil 222 may be approximately equal to a ratio of the BL values at the positive and negative limit amplitudes of the BL curve of the voice coil assembly 22, namely, the ratio of the BL values at the two ends of the X axis of the BL curve of the voice coil assembly 22.

As an improvement of the embodiment, a thickness of the first voice coil 221 is equal to a thickness of the second voice coil 222. The thickness of the first voice coil 221 refers to a distance between two surfaces of the first voice coil 221 in a direction perpendicular to the vibrating direction of the first voice coil 221, and a thickness of the second voice coil 222 refers to a distance between two surfaces of the second voice coil 222 in a direction perpendicular to the vibrating direction of the second voice coil 222.

As an improvement of the embodiment, the speaker further includes an elastic supporting member 50. One side of the elastic supporting member 50 is connected to the auxiliary pole plate 322, and the other side is connected to the voice coil assembly 22. With the above structure of the elastic supporting member 50, the elastic supporting member 50 supports the voice coil assembly 22, so that the vibration of the voice coil assembly 22 is more stable, and the sound quality is thus improved.

As an improvement of the embodiment, the speaker is provided with two elastic supporting members 50. The voice coil assembly 22 has a rectangular structure with round corners. Both auxiliary magnets 321 are provided on two sides of a long axis of the voice coil assembly 22, and both elastic supporting members 50 are provided on two sides of a short axis of the voice coil assembly 22. The double elastic supporting assembly 50 is arranged symmetrically, so that the supporting effect of the voice coil assembly 22 is more stable, thus to prevent the voice coil assembly 22 swinging laterally and to have a better effect.

As an improvement of the embodiment, the auxiliary pole plate 322 has an annular shape. The auxiliary pole plate 322 includes first pole plate portions 401 arranged opposite to the two auxiliary magnets 321 and two second pole plate portions 402 sandwiched and arranged between the two first pole plate portions 401. One side of each elastic supporting member 50 is connected to one of the second pole plate portions 402, the other side is connected to the voice coil assembly 22. It should be noted that one side of the elastic supporting member 50 is not limited to connect to the auxiliary pole plate 216. For example, one side of the elastic supporting member 50 may also be configured to connect with frame 10.

As an improvement of the embodiment, each elastic supporting member 50 includes a first fixing arm 51 connected to the second pole plate portions 402, a second fixing arm 52 connected to the voice coil assembly 22 and an elastic arm 53 connected between the first fixing arm 51 and the second fixing arm 52.

As an improvement of the embodiment, the second fixing arm 52 is sandwiched and arranged between the first voice coil 221 and the second voice coil 222. It should be noted that a distance between the first voice coil 221 and the second voice coil 222 can be adjusted by setting the thickness of the second fixing arm 52 according to practical needs, so as to realize the adjustment of the BL curve of the first voice coil 221 and the second voice coil 222, thus the voice coil assembly 22 can be suitable for speakers with different maximum amplitudes.

As an improvement of the embodiment, the elastic supporting member 50 is a flexible circuit board, the first voice coil 221 and the second voice coil 222 are electrically connected to the elastic supporting member 50. By setting the elastic support member 50 as a flexible circuit board, the supporting structure and power supply structure of the voice coil assembly 22 are designed integrally, so that the speaker 100 has a more compact structure.

Figure 11:
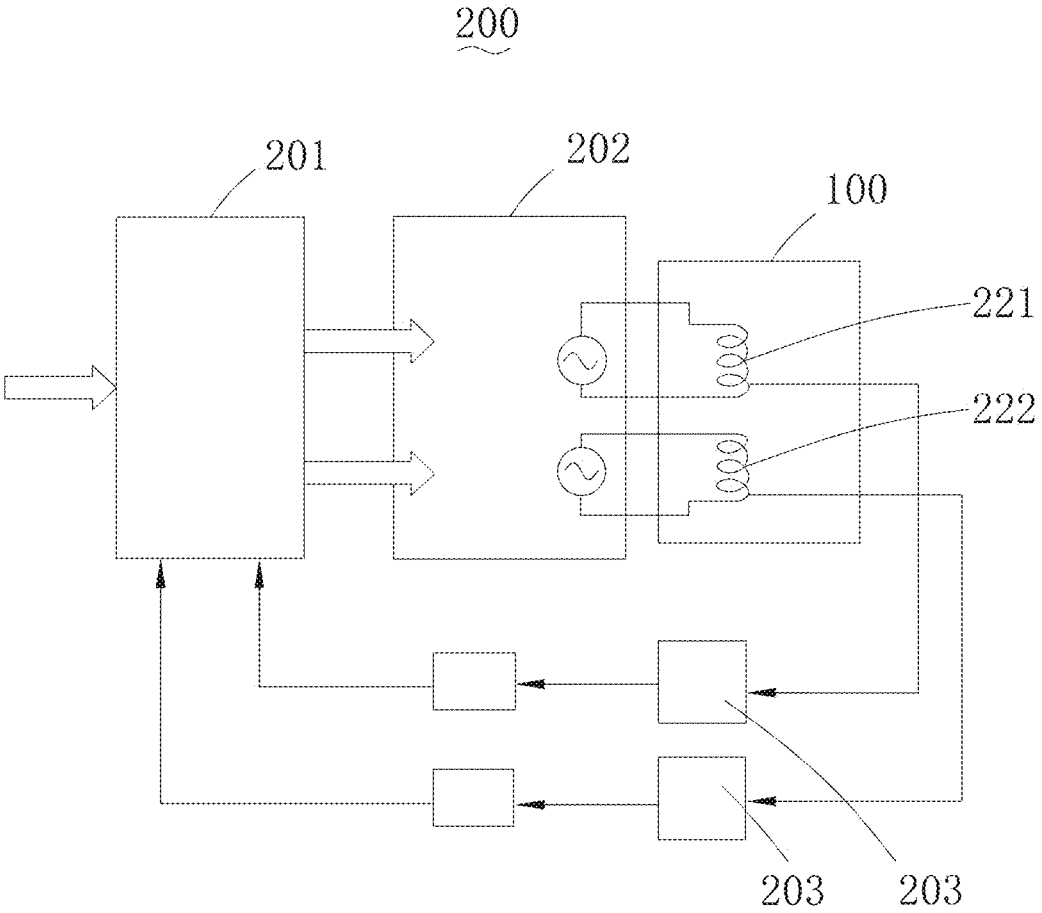
FIG. 11 is a block schematic view of the speaker system according to the embodiment of the present invention.

Referring to FIG. 11, the embodiment of the present invention further discloses a speaker system 200. The speaker system 200 includes a controller 201, a power amplifier 202, and the above-mentioned speaker 100. The controller 201 is electrically connected to the power amplifier 202, and the power amplifier 202 is electrically connected to the speaker 100. Specifically, the power amplifier 202 is electrically connected to the first voice coil 221 and the second voice coil 222. The controller 201 is used for controlling electrical signals to be input to the first voice coil 221 and the second voice coil 222. Namely, when a joint of the first voice coil 221 and the second voice coil 222 is located in the magnetic line concentrating area 42, electric signals are input to the first voice coil 221 and the second voice coil 222 at the same time. if in the magnetic line concentrating area 42 locates only the first voice coil 221, an electric signal is input only to the first voice coil 221. If in the magnetic line concentrating area 42 locates only the second voice coil 222, an electric signal is input only to the second voice coil 222.

As an improvement of the embodiment, the controller 201 is further used for predicting the position of the voice coil assembly 22 according to the electric signals input to the first voice coil 221 and the second voice coil 222, so as to optimize the electric signals input to the first voice coil 221 and the second voice coil 222 subsequently, thus to improve the performance of the speaker. Specifically, the controller 201 is provided with calculation instruction. The controller 201 executes the calculation instruction to perform the following steps:

step 1, according to the electrical signal input in the current frame and the previous frame, calculating the current position of the annular vibrating diaphragm via the speaker model;

step 2, based on the current position of the annular vibrating diaphragm, calculating the input signal of the next frame to predict the position where the annular vibrating diaphragm should move when the electric signal is input in the next frame, and the positions of the first voice coil and the second voice coil in the magnetic circuit assembly.

After predicting the positions of the first voice coil 221 and the second voice coil 222, the vibrating effect of the annular vibrating diaphragm is improved by optimizing the electric signals input to the first voice coil 221 and the second voice coil 222 in the next frame.

In other embodiments, the speaker system 200 further includes two sensors 203, and both sensors 203 are electrically connected to the controller 201. Both sensors 203 are used to detect the real-time positions of the first voice coil 221 and the second voice coil 222 respectively and to pass the detected signals to the controller 201. The controller 201 optimizes the electric signals input to the first voice coil 221 and the second voice coil 222 by the next frame according to the detected signals of two sensors 203, thus to enhance the vibrating effect of the annular vibrating diaphragm.

Figure 12:
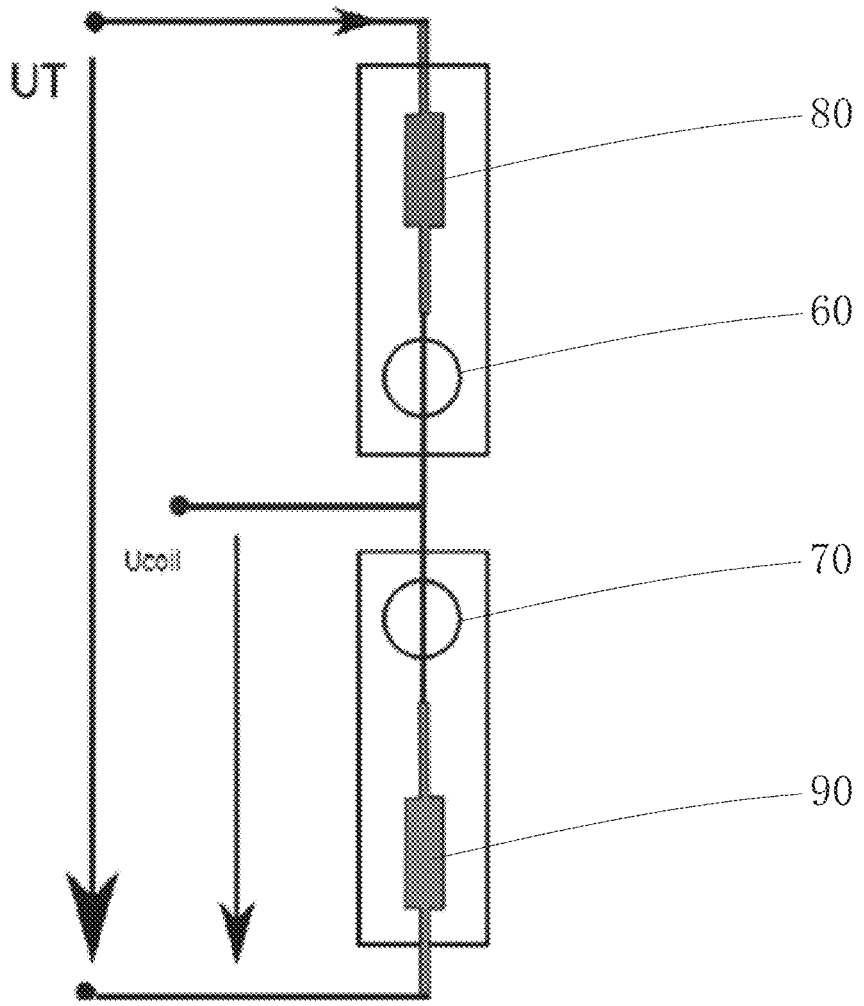
FIG. 12 is a structure schematic view of the prior dual voice coil connecting in series.

Please refer to FIG. 12, in the method of the prior dual voice coils connected in serial, an upper voice coil 60 and a lower voice coil 70 are connected in series, the upper voice coil 60 is connected with the first rotary variable digital converter 80 in series, and the lower voice coil 70 is connected with the second rotary variable digital converter 90 in series. When calculating the displacements of the upper voice coil 60 and the lower voice coil 70, BL is used as a constant. The speed of the voice coil is calculated through induced electromotive force, and then a displacement is obtained through integrating the speed.

$$V_{cell}=U_T/BL;$$

$$X=\int_0^T V_{coil}dt+b;$$

wherein, $V_{coil}$ is an operating speed of the voice coil assembly, X is a displacement of the voice coil assembly, $U_T$ is an electromotive force of the voice coil assembly, BL is a product of gap magnetic induction and effective voice coil wire length, and b is a constant.

There are disadvantages in the existing calculating method.

BL will change according to the displacement X in actual use, and is not a constant.

The constant b needs to be calibrated separately (affected by the non-linearity of material and structure, a dynamic equilibrium position and a static equilibrium position of the speaker are different; the constant b is not a definite quantity, which cannot be achieved via simple product detection, so it is difficult to calibrate the constant b accurately).

In the independent controlling method for the first voice coil and the second voice coil according to the embodiment, the electromotive force of the first voice coil is set as $U_1$, the electromotive force of the second voice coil is set as $U_2$, and a formula can be obtained according to the same vibrating speed of the first voice coil and the second voice coil.

$$\frac{U_1(t)}{BL_1(x(t))}=\frac{U_2(t)}{BL_2(x(t))};$$

$BL_1(x)$ and $BL_2(x)$ are assumed as linear forms:

$$BL_1(x)=ax+BL_0;$$

$$BL_2(x)=-ax+BL_0;$$

so a formula can be obtained:

$$x(t)=\frac{BL_0}{a}\times\frac{U_1(t)\,U_2(t)}{U_1(t)+U_2(t)}.$$

Compared with the method of the prior dual voice coil connected in serial, the linearity of the equivalent BL of the speaker can be improved with the independent controlling method of the first voice coil 221 and the second voice coil 222 according to the embodiment, therefore the problem of time distortion caused by BL nonlinearity can be reduced.

The above description is only preferred embodiment of the present invention, and it should be noted that those skilled in the art can also make improvements without departing from the inventive concept of the present invention, but these improvements all belong to the protection scope of the invention.

What is claimed is:

1. A speaker, comprising a vibrating system and a magnetic circuit system for driving the vibrating system to vibrate and generate sound, wherein, the magnetic circuit system has a magnetic gap, the vibrating system comprises a vibrating assembly and a voice coil assembly connected to the vibrating assembly for driving the vibrating assembly to vibrate, the voice coil assembly is inserted into the magnetic gap;

the magnetic circuit system has a magnetic line concentrating area in the magnetic gap, the voice coil assembly comprising a first voice coil connected to the vibrating assembly and a second voice coil connected to the first voice coil at a side away from the vibrating assembly;

if the first voice coil located in the magnetic line concentrating area, an electric signal is input only to the first voice coil;

if the second voice coil located in the magnetic line concentrating area, an electric signal is input only to the second voice coil, the speaker further comprises an elastic supporting member for elastically supporting the voice coil assembly, the elastic supporting member comprises a first fixing arm connected to a fixed part of the speaker, a second fixing arm connected to the voice coil assembly, and an elastic arm connected between the first fixing arm and the second fixing arm, the second fixing arm is sandwiched between the first voice coil and the second voice coil, a thickness of the second fixing arm adjusts a distance between the first voice coil and the second voice coil for adjusting a BL curve of the first voice coil and a BL curve of the second voice coil.

2. The speaker according to claim 1, wherein the magnetic circuit system includes a magnetic bowl and a magnet assembly fixed in the magnetic bowl and forming the magnetic gap with the magnetic bowl; the magnet assembly comprises a magnet and a pole plate stacked on the magnet, the pole plate includes a first surface connected to the magnet and a second surface arranged opposite to the first surface, an area of the magnetic gap located between a plane where the first surface is located and another plane where the second surface is located is the magnetic line concentrating area.

3. The speaker according to claim 1, wherein the magnetic circuit system comprises a main magnet assembly and an auxiliary magnet assembly spaced apart from the main magnet assembly and forming the magnetic gap; the main magnet assembly includes a first main magnet and a main pole plate stacked on the first magnet, the auxiliary magnet assembly includes two first auxiliary magnets symmetrically arranged on two opposite sides of the first main magnet and an auxiliary pole plate stacked on the first auxiliary magnets; a plane connecting an upper surface of the main pole plate with an upper surface of the auxiliary pole plate is defined as a first plane, another plane connecting a lower surface of the main pole plate with a lower surface of the auxiliary pole plate is defined as a second plane, an area of the magnetic gap located between the first plane and the second plane is the magnetic line concentrating area.

4. The speaker according to claim 3, wherein the main magnet assembly further comprises a second main magnet arranged on the main pole plate at a side away from the first main magnet, the auxiliary magnet assembly further comprises a second auxiliary magnet arranged on the auxiliary pole plate at a side away from the first auxiliary magnet; the corresponding ends of the first main magnet and the second main magnet have the same polarity, the corresponding ends of the first auxiliary magnet and the second auxiliary magnet have the same polarity, and the polarity of the corresponding ends of the first main magnet and the second main magnet is opposite to the polarity of the corresponding ends of the first auxiliary magnet and the second auxiliary magnet.

5. The speaker according to claim 3, wherein the speaker further comprises a frame for receiving the vibrating system and the magnetic circuit system; the first fixing arm of the elastic supporting member is connected to the auxiliary pole plate or the frame.

6. The speaker according to claim 5, wherein the speaker has two elastic supporting members, the voice coil assembly has a rectangular structure with rounded corners, the two first auxiliary magnets are arranged on two sides of the voice coil assembly corresponding to a long axis of the voice coil assembly, and the two elastic supporting members are arranged on two sides of the voice coil assembly corresponding to a short axis of the voice coil assembly.

7. The speaker according to claim 6, wherein the auxiliary pole plate has an annular shape, the auxiliary pole plate comprises two first pole plate portions each opposite to the corresponding first auxiliary magnet and two second pole plate portions sandwiched between the two first pole plate portions; the first fixing arm of each elastic supporting member is connected to one of the second pole plate portions.

8. The speaker according to claim 1, wherein the elastic supporting member is a flexible circuit board, the first voice coil and the second voice coil are electrically connected to the elastic supporting member.

9. The speaker according to claim 1, wherein the vibrating assembly comprises an annular vibrating diaphragm and a dome arranged on the inner side of the annular vibrating diaphragm, and the first voice coil is connected to the annular vibrating diaphragm.

10. The speaker according to claim 1, wherein a height of the first voice coil is equal to a height of the second voice coil.

11. The speaker according to claim 1, wherein a thickness of the first voice coil is equal to a thickness of the second voice coil.

* * * * *